US005125161A

United States Patent [19]

Guthrie

[11] Patent Number: 5,125,161

[45] Date of Patent: Jun. 30, 1992

[54] DRAFTING INSTRUMENT

[76] Inventor: Darren E. Guthrie, 2216 Northhollow Dr., Elko, Nev. 89801

[21] Appl. No.: 670,450

[22] Filed: Mar. 8, 1991

Related U.S. Application Data

[63] Continuation of Ser. No. 497,974, Mar. 23, 1990, abandoned.

[51] Int. Cl.[5] ..... B43L 9/04

[52] U.S. Cl. ..... 33/27.03; 33/27.01

[58] Field of Search ..... 33/27.01, 27.03

[56] References Cited

U.S. PATENT DOCUMENTS

| | | | |
|---|---|---|---|
| 601,455 | 3/1898 | Wildman et al. | 33/27.03 |
| 888,848 | 5/1908 | Rapson | 33/27.03 |
| 991,693 | 5/1911 | Brown | 33/27.03 |
| 1,154,673 | 9/1915 | Van Ness | 33/27.03 |
| 1,808,705 | 6/1931 | Owen, Jr. | 33/27.03 |
| 2,255,454 | 9/1941 | Rust | 384/615 |
| 2,624,117 | 1/1953 | Paci | 33/27.03 |
| 2,958,132 | 11/1960 | Hartbauer et al. | 33/27.03 |
| 3,460,261 | 8/1969 | Frey | 33/27.03 |
| 3,465,445 | 9/1969 | Fisher | 33/27.03 |
| 3,805,390 | 4/1974 | Craig | 33/494 |
| 4,353,166 | 10/1982 | Kettlestrings | 33/27.03 |
| 4,899,449 | 2/1990 | Fouladian | 33/27.03 |

FOREIGN PATENT DOCUMENTS

| | | | |
|---|---|---|---|
| 217974 | 4/1987 | European Pat. Off. | 33/27.03 |
| 334695 | 3/1921 | Fed. Rep. of Germany | 33/27.03 |
| 89/04770 | 6/1989 | PCT Int'l Appl. | 33/27.03 |
| 746099 | 3/1956 | United Kingdom | 33/27.03 |

*Primary Examiner*—Thomas B. Will
*Attorney, Agent, or Firm*—Cort Flint

[57] ABSTRACT

A circle drafting instrument (A) comprises a support member (12) rotatably mounting a slotted disk (10). A line forming point (50) is positioned in a slot (B) at a selected distance from a center point (36) of disk (10). Slot B has offset apexes (44*a*, 46*a*) incremental radially along disk (10) for precision circle drafting. Additional slots (C, D, E) may also be provided for a larger number of increments. The forming point and the disk are rotated in the support so as to form a circle of a desired size.

19 Claims, 2 Drawing Sheets

DRAFTING INSTRUMENT

This is a continuation of copending application Ser. No. 07/497,974, filed on Mar. 23, 1990, now abandoned.

BACKGROUND OF THE INVENTION

This invention relates to a drafting instrument for forming circles.

The prior art provides several different circle drawing devices. U.S. Pat. No. 1,154,673 describes a drafting implement which is comprised of a triangle and protractor combination. The protractor is rotatably positioned within the triangle. A plurality of openings within the protractor enable circles of varying diameters to be drawn by inserting a pen or pencil into a hole and by revolving the protector within the triangle. U.S. Pat. No. 4,353,166 describes a device for drawing circles wherein a disk is rotatably carried on a sheet. The disk and sheet each have a series of holes spaced from a center point of the disc into which the tip of a suitable writing instrument may be placed to rotate the disc or sheet with respect to the other to inscribe a circle on a desired surface. U.S. Pat. No. 3,460,261 describes a drafting device which includes a support member and a rotatable member positioned within the support member. To draw circles, the rotatable member is removed from the support member. A pointed instrument may then be inserted into one of the apertures within the rotatable member to serve as the center of the circle and a pencil point may be inserted in any other selected aperture for drawing a circle by the rotating member. U.S. Pat. No. 3,465,445 describes a drawing and design apparatus for drawing circles and other geometric shapes. However, these devices do not allow intricate size selection, and are not suitable for a precision drafting instrument. Most of the devices require the use of a sharp center point which damages the surface to be marked.

SUMMARY OF THE INVENTION

The present invention provides a device for drawing circles which has no sharp center points. Intricate selection of circle size is provided by a calibrated and notched slot arrangement in a disk member. The slot extends parallel to a radii of the disk. The disk is mounted on bearing members in a position spaced from the marking surface. This allows for smooth and unrestricted rotation of the disk and eliminates smear marks on the marked surface. Diameter indicating lines, center opening, alignment cross lines and measuring indica are provided to assist in centering the device for use and for observing the line being drawn.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
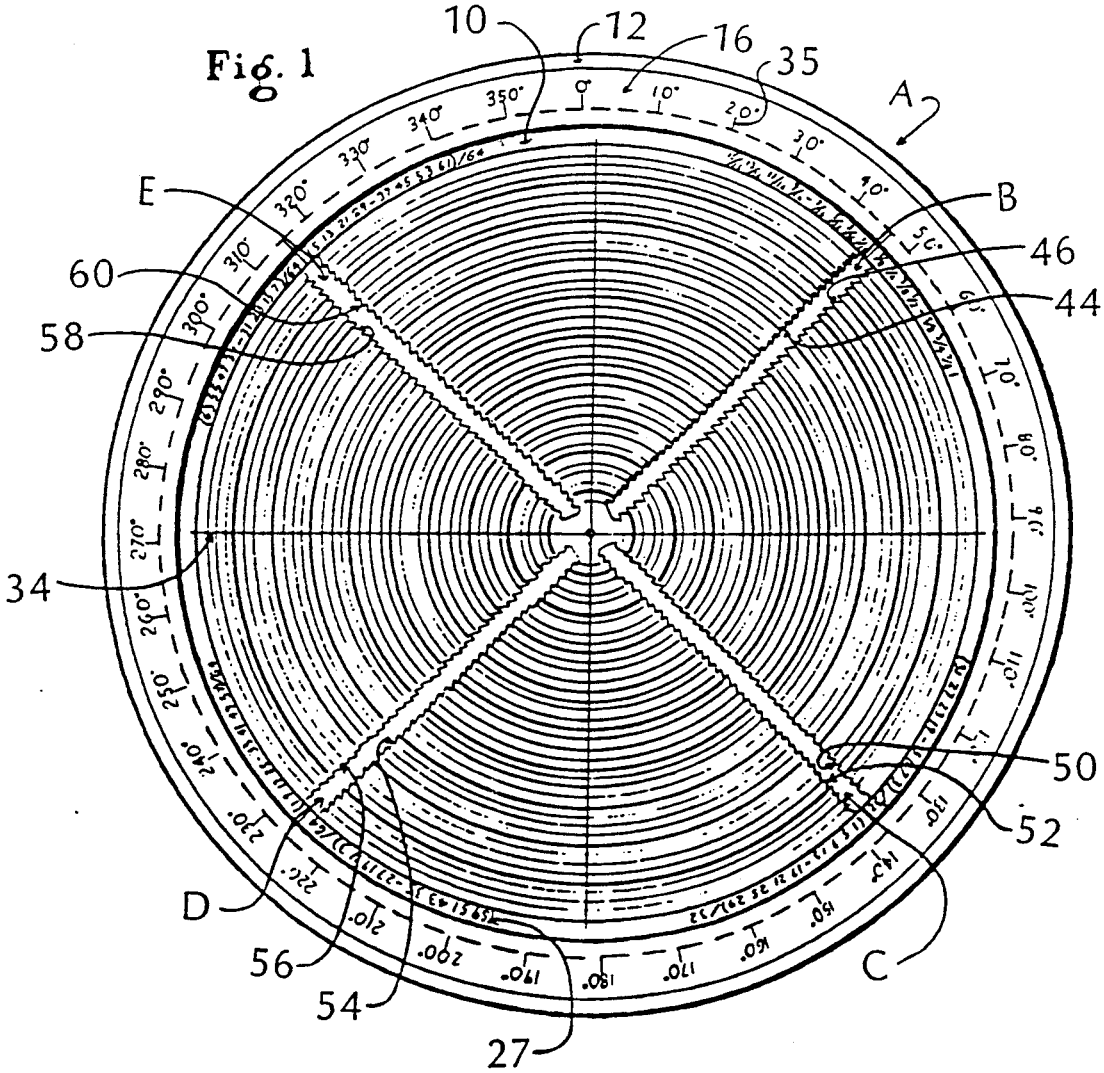
FIG. 1 is a top plan elevation view of the device embodying the invention.

A device for forming circles is generally shown in FIG. 1 as comprised of a rotatable template or disk member 10 and a support member 12. The support member is preferably formed of a plastic material in the shape of a ring having a circular opening of a given size. Support member 12 is comprised of a first plate member 14 and a second, annular plate member 16, as can best be seen in FIG. 3. First plate member 14 has an upper surface 18, an inner edge 20 and a lower support surface 22. An L-shaped bushing 24 is formed near inner edge 20 of plate 14 above support surface 22. Plate 14 has a notch 28 formed in its upper surface 18.

Plate 16 is formed of a transparent plastic material and measuring indica 27, as can best be seen in FIG. 1, is arranged around a notch 28 of plate 14 below plate 16. The measuring indica acts to assist the user when forming part circles.

Figure 5:
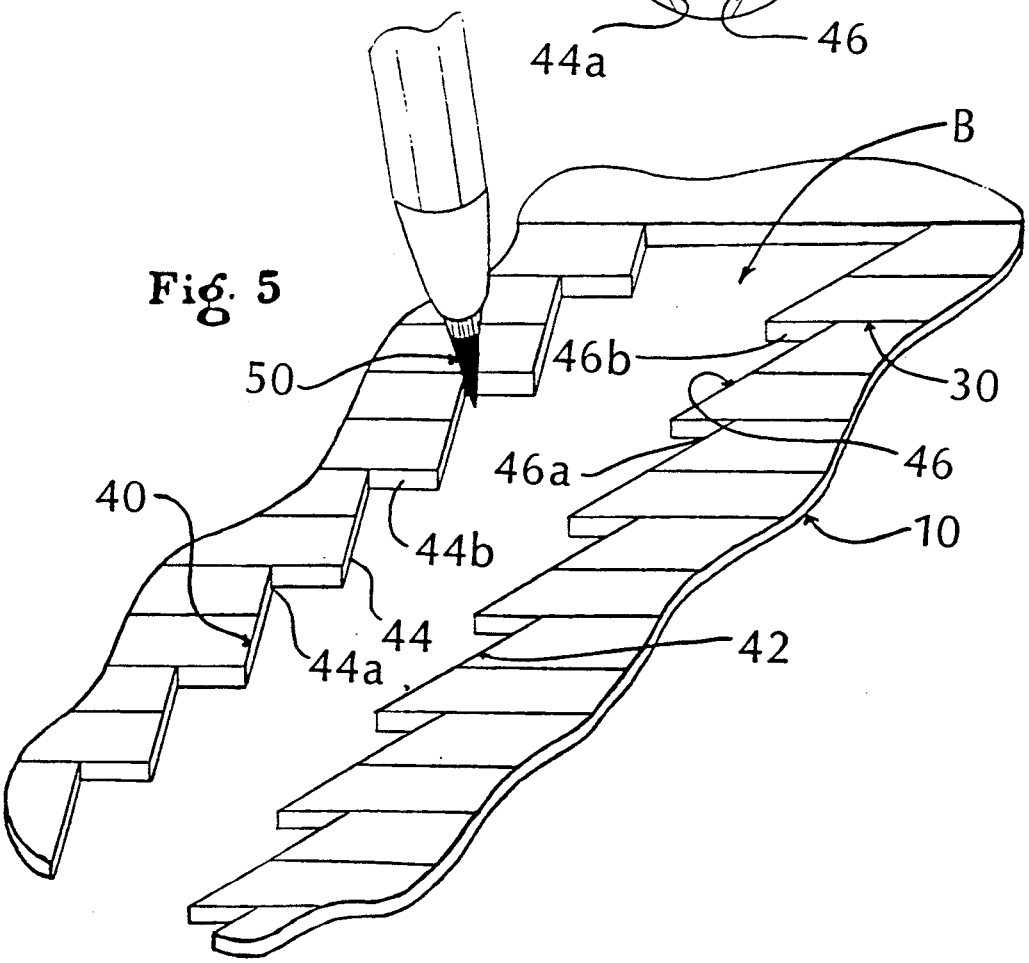
FIG. 5 is an enlarged perspective view of an incremental circle slot according to the invention.

Disk member 10 is also preferably made of transparent plastic material. Diameter indicating lines 30 are arranged at spaced intervals on one surface of the disk, as can best be seen in FIG. 1 and 5. The lines may be spaced at intervals of between 1/16 inch and 1 inch with 1/16 inch intervals being preferred. Lines 30 allow the user to easily determine the path of the circle being drawn.

Figure 2:
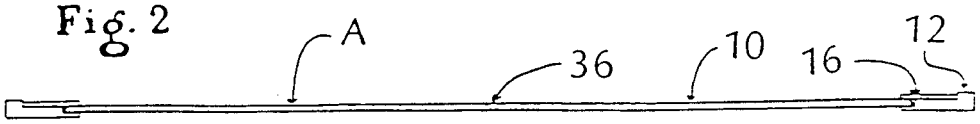
FIG. 2 is a side elevation of the device shown in FIG. 1.
Figure 4:
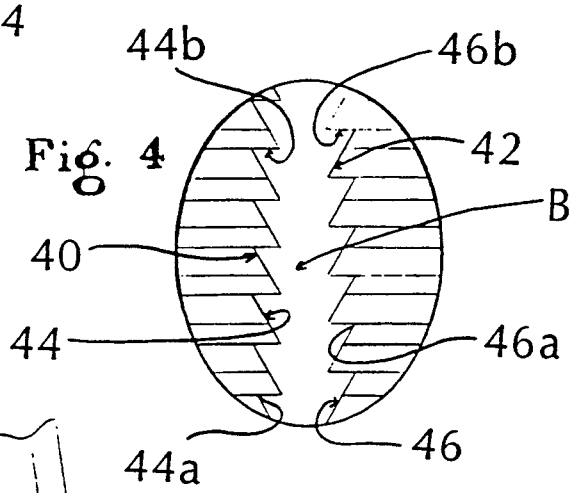
FIG. 4 is an enlarged partial plan view of an incremental circle guide slot.

Disk 10 is also provided with alignment cross lines 34. The cross lines are arranged at 90° to each other and pass through a beveled center opening 36 of disk 10, as best seen in FIGS. 1 and 2. Protractor indicating lines 35 allow the user to divide a circle into a desired number of parts or to form part circles. Incremental circle guide slot B is formed in disk 10 to extend parallel to a radii thereof. Slot B begins at a point approximately $\frac{1}{8}$ inch from the center point of disk 2 and may be up to 5 inches in length. Slot B terminates at a point adjacent the circumference of disk 10. Slot B consists of a first edge 40 and a second edge 42. Wedge-shaped notches 44 and 46 are formed in edges 40 and 42, respectively, at intervals of 1/8 an inch as can best be seen in FIGS. 4 and 5. An apex 44*a* of notches 44 formed in edge 40 are offset relative to an apex 46*a* of notches 46 formed in edge 42, as can best be seen in FIG. 4. Notches 44 and 46 are offset by 1/16 of an inch. Notches 44 begin at 1/16 and notches 46 begin at $\frac{1}{8}$ of an inch from center. While this arrangement is preferred, it is also possible to provide notches in only one of edges 40, 42. It is also possible to arrange slot B so that it extends from the center point at a slight angle relative to the radii of disk 10. Preferably, there are 3 other incremental circle guide slots C, D, and E, each having notches offset notches so that a full range of 1/64 inch diameter increments is provided from 0 to 5 inches (or other radius as defined by the diameter of disk 10).

Apexes 44*a* and 46*a* are offset in radial increments along a radial from the center 36 of disk member 10 to provide for drafting of circles in fine precision increments. A generally straight surface 44*b* and 46*b* projects circumferentially from respective apexes 44*a*, 46*a* to better confine writing point 50 during circle formation, as can best be seen in FIG. 5. Surfaces 44*b*, 46*b* make acute angles at apexes 44*a*, 46*a*.

Edges 40 and 42 are spaced apart a distance which allows the point of a conventional line forming member to be placed therebetween. Notches 44, 46 accurately and securely hold the forming point 50 (FIG. 5) at a desired distance from the center point of disk 10. To assist in selecting the desired location of the forming point measuring indica may be provided along edge 42 of slot B.

Figure 3:
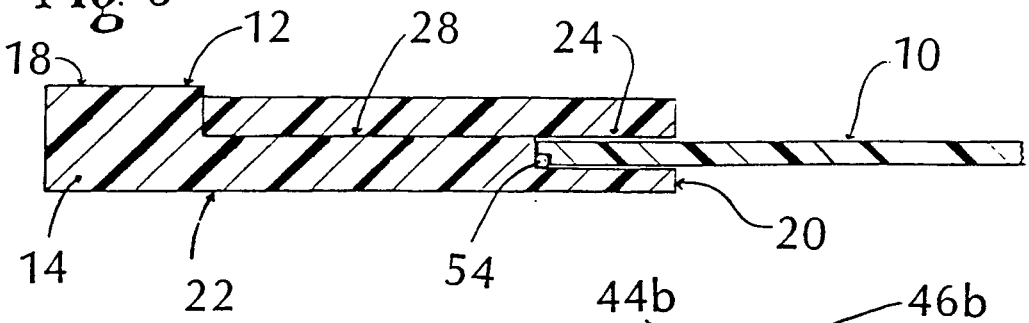
FIG. 3 is a detailed partial section view of the device shown in FIG. 1.

As can best be seen in FIGS. 2 and 3, disk 10 is positioned on a ball bearing 54 in bushing 24 of plate 14 in a position which is elevated above support surface 22. This eliminates smear marks when the device is in use because disk 10 is spaced above a surface on which a circle is being formed. Such an arrangement also reduces friction between disk 10 and support member 22 thereby assisting in smooth and easy rotation of the disk.

Second annular plate 16 is secured by any suitable means in notch 28 cut in support 12, and is of sufficient width so that an edge thereof extends above bearing 54 and secures disk 10 in bushing 24.

In use, beveled center hole 36 of disk 10 is located over the axis of a circle to be formed. Line forming member 50 is positioned in a notch 44, 46 at a selected distance from the center point of disk 10. The disk and forming member are rotated about the center point thereby forming an accurate circle. Guide slots C, D, and E include ⅛ inch incremental notches 50, 52; 54, 56; and 58, 60 (FIG. 1) which are offset 1/16 of an inch, and are identical in construction to notches 44, 46. Guide slots B, C, D, and E, in the template quadrants, provide a full range of circles with radii in 1/128 of an inch may be found. This provides a very accurate precision circle drafting tool.

In an alternative form of the device, the exterior shape of support member 1 may be configured as a usual triangle member (not shown) or any other geometrical shape whereby it may be encased. The arrangement of disk 10 relative to the support triangle may be the same arrangement as in FIG. 3.

While a preferred embodiment of the invention has been described using specific terms, such description is for illustrative purposes only, and it is to be understood that changes and variations may be made without departing from the spirit or scope of the following claims.

What is claimed is:

1. A drafting instrument for forming circles comprising:

a support member having an upper surface, a lower support surface and an inner edge forming a circular opening of given diameter;

a bearing surface formed on said inner edge of said support member;

a circular disk member of a diameter slightly less than said given diameter so as to be rotatably received on said bearing surface in a position vertically spaced from said support surface;

an incremental circle guide slot having first and second edges formed in said disk member, said slot located to begin adjacent to a center point of said disk, to extend along a line parallel with a radii of said disk member and to terminate at a point adjacent to the circumference of said disk;

said slot having a plurality of wedge-shaped notches of equal size and equal spacing and which include generally straight circumferentially extending surfaces facing said center point and forming an acute angle at their apexes with intersecting surfaces of said notches, said notches being arranged along at least one of said first and second edges;

said first and second edges being spaced at a width sufficient to receive and positively locate a forming point in said apexes so that said point is disposed entirely within one of said notches and is contacted only by said circumferentially extending and intersecting surfaces; and whereby upon exertion of pressure in a direction outward from said center point, said disk is rotated and a circle of selected size is accurately formed.

2. The device of claim 1 wherein said wedge-shaped notches are formed along said first and second edges.

3. The device of claim 2 wherein said wedge-shaped notches along said first and second edges are arranged to provide circumferentially offset apexes which incrementally locate said forming point at increments radially along said disk member.

4. The device of claim 1 wherein said wedge-shaped notches are spaced along said one of said first and second edges at intervals of 1/16 inch.

5. The device of claim 1 wherein said slot is up to 5 inches in length.

6. The device according to claim 1 wherein said disk is transparent and includes a plurality of diameter indicating lines arranged on said disk.

7. The device according to claim 1 wherein measuring indica is arranged on said upper support surface adjacent to said circular opening.

8. The device according to claim 1 wherein alignment cross lines are arranged on said disk member, said lines passing through said center point and being disposed at 90° to each other.

9. The device according to claim 1 wherein the support member is formed of first and second plastic plates, said bearing surface being formed in said first plate.

10. The device according to claim 9 wherein said second plate is formed of clear plastic and is secured to said first plate member so as to extend above measuring indicia and said bearing surface thereby covering said indicia while securing said disk in said bearing.

11. The device according to claim 1 wherein said bearing surface is formed as an L-shaped shoulder having a vertical peripheral surface and a horizontal surface, individual bearing members arranged about an apex formed by said peripheral surface and said horizontal surface, said bearing members engaging an outer edge of said circular disk to position said disk horizontally spaced from said peripheral surface and vertically spaced from said horizontal surface.

12. The device according to claim 1 including a plurality of incremental circle guide slots spaced circumferentially about said disk, said slots having said wedge-shaped notches radially spaced and offset from one another to provide an increased number of circle drawing increments.

13. A drafting instrument for forming circles comprising:

a support member having a bearing surface for rotatably receiving a disk member;

an incremental circle guide slot having first and second edges formed in said disk member and extending from a point adjacent to the center point of said disk to a point adjacent to the circumference of said disk;

said first and second edges being spaced at a width sufficient to receive and positively locate a forming point;

said first and second edges being provided with a plurality of wedge-shaped notches having apexes arranged to be offset from each other so as to allow each notch to locate said forming point at an incremental radial location relative to the center point of said disk;

whereby upon rotation of said disk a circle of selected size is accurately formed.

14. The device of claim 13 wherein said bearing surface is raised relative to a lower support surface of said support member to elevate said disk above a circle forming surface.

15. The device of claim 13 wherein the disk member is formed of clear plastic which is provided with a plurality of diameter indicating lines and measuring indicia.

16. The device of claim 13 wherein said wedge-shaped notches including generally straight circumferential surfaces forming an acute angle at said apexes for confining said forming point.

17. The device according to claim 13 including a plurality of incremental circle guide slots spaced circumferentially about said disk, said slots having said wedge-shaped notches radially spaced and offset from one another to provide an increased number of circle drawing increments.

18. The device according to claim 13 wherein protractor measuring indica is arranged on said upper support surface adjacent to said circular opening.

19. The device according to claim 13 including diameter measuring indicia arranged on said disk around a periphery thereof in proximate relation to said guide slot for selecting a notch corresponding to a desired diameter.

* * * * *